US007181868B2

(12) United States Patent
Auger et al.

(10) Patent No.: US 7,181,868 B2
(45) Date of Patent: Feb. 27, 2007

(54) ARTICLE OF FOOTWEAR HAVING A SOLE WITH A FLEX CONTROL MEMBER

(75) Inventors: Perry Auger, Tigard, OR (US); Troy Lindner, St. Michael, MN (US); Peter A. Hudson, Portland, OR (US)

(73) Assignee: Nike, Incorporated, Beaverton, OR (US)

( * ) Notice: Subject to any disclaimer, the term of this patent is extended or adjusted under 35 U.S.C. 154(b) by 0 days.

(21) Appl. No.: 10/179,033

(22) Filed: Jun. 26, 2002

(65) Prior Publication Data

US 2004/0000074 A1 Jan. 1, 2004

(51) Int. Cl.
*A43B 13/00* (2006.01)
*A43B 5/02* (2006.01)

(52) U.S. Cl. ..... 36/103; 36/128; 36/134; 36/67 A; 36/59 R

(58) Field of Classification Search ..... 36/102, 36/107, 126, 127, 128, 28, 30 R, 43, 44
See application file for complete search history.

(56) References Cited

U.S. PATENT DOCUMENTS

| | | | | |
|---|---|---|---|---|
| 2,680,919 | A * | 6/1954 | Riggs | 36/43 |
| 4,454,662 | A * | 6/1984 | Stubblefield | 36/102 |
| 4,881,329 | A | 11/1989 | Crowley | |
| 5,319,866 | A * | 6/1994 | Foley et al. | 36/103 |
| 5,452,526 | A | 9/1995 | Collins | |
| 5,607,756 | A * | 3/1997 | Yamauchi et al. | 36/44 |
| 5,832,636 | A * | 11/1998 | Lyden et al. | 36/127 |
| 6,119,373 | A * | 9/2000 | Gebhard et al. | 36/103 |
| 6,219,940 | B1 | 4/2001 | Kita | |
| 6,321,469 | B1 * | 11/2001 | Cretinon | 36/102 |
| 6,421,933 | B1 * | 6/2002 | Zamprogno | 36/43 |
| 6,499,235 | B2 * | 12/2002 | Lussier et al. | 36/126 |
| 6,557,270 | B2 * | 5/2003 | Nakano et al. | 36/30 R |

(Continued)

FOREIGN PATENT DOCUMENTS

EP 0 352 807 1/1990

(Continued)

OTHER PUBLICATIONS

Raychem Corporation, Nitinol Solutions, 6 sheets, printed Apr. 1999.

(Continued)

*Primary Examiner*—Jila M. Mohandesi
(74) *Attorney, Agent, or Firm*—Banner & Witcoff, Ltd.

(57) ABSTRACT

An article of footwear includes an upper for holding a foot of a wearer and a sole having an outsole plate. Several ground engaging members extends downwardly from the outsole plate to provide traction. The outsole plate includes a flex control member composed of a superelastic shape memory material or a nickel-titanium alloy. The flex control member can be coupled to an inside surface, or bottom surface of the outsole plate. The outsole plate may include a rearfoot region, a midfoot region, and a first metatarsal head region, in which the regions generally correspond to the skeletal structure of a human foot. The flex control member extends from a medial side of the rearfoot region through the midfoot region and into the first metatarsal head region of the outsole plate. The ground engaging members may be positioned to extend from the location of the flex control member.

14 Claims, 6 Drawing Sheets

U.S. PATENT DOCUMENTS

| | | | |
|---|---|---|---|
| 2001/0001907 | A1 | 5/2001 | Luthli et al. |
| 2002/0038522 | A1 | 4/2002 | Houser et al. |
| 2002/0062578 | A1 | 5/2002 | Lussier et al. |

FOREIGN PATENT DOCUMENTS

| | | |
|---|---|---|
| EP | 0 373 330 A1 | 6/1990 |
| EP | 0 958 752 | 11/1999 |
| JP | 2001 017205 | 1/2001 |

OTHER PUBLICATIONS

NDC (Nitinol Device & Components) Nitnol Applications, webpage, 9 sheets, printed Dec. 4, 2000.

* cited by examiner

ARTICLE OF FOOTWEAR HAVING A SOLE WITH A FLEX CONTROL MEMBER

FIELD OF THE INVENTION

The present invention generally relates to an article of footwear. More specifically, the invention relates to an article of footwear having a flex control member in the sole.

BACKGROUND OF THE INVENTION

Numerous consumers and athletes purchase footwear for use in athletic activities such as running, cross training, soccer, football, baseball, basketball, tennis, walking, and the like. The shoes worn by the athlete can effect the performance and contribute to their overall success in an athlete event. A typical athletic shoe includes a sole and an upper extending upwardly from the sole and into which the foot of the athlete is positioned and secured in place. The sole provides traction, protection, and a durable wear surface.

Conventional cleated footwear has certain drawbacks in design and function. A dilemma related to cleated footwear is the difficulty in finding an ideal balance of various factors for performance purposes. In one balancing factor, the shoe should perform well under the high impact loading to withstand stress and strain on various portions of the shoe. Another balancing factor involves providing torsional rigidity and stiffness of the outsole plate while maintaining a lightweight shoe. Another factor to balance includes providing an outsole plate that is rigid for support and traction, while being lightweight and somewhat flexible for performance purposes. Accordingly, there is a need for a cleated article of footwear, including not but limited to use in the sport of soccer that provides an ideal balance between these factors and needs.

SUMMARY OF THE INVENTION

The present invention pertains to a flex control member in an outsole plate. In another aspect, the outsole plate is attached to an article of footwear.

In one aspect of the present invention, an article of footwear includes an upper for holding a foot of a wearer and a sole having an outsole plate. A plurality ground engaging members extend downwardly from the outsole plate to provide traction. The outsole plate includes a flex control member coupled to an inside surface or bottom surface in which the flex control member is composed of a superelastic shape memory material. In this manner, a wearer is provided with increased spring-like energy return for faster and stable acceleration movement of the foot of the wearer.

In another aspect of the invention, an article of cleated footwear includes an upper for holding a foot of a wearer and a sole having an outsole plate. A plurality ground engaging members extend downwardly from the outsole plate to provide traction. The outsole plate includes a rearfoot region, a midfoot region, and a first metatarsal head region, in which the regions generally correspond to the skeletal structure of a human foot. An elongated flex control member is coupled to the outsole plate. The elongated flex control member extends from a medial side of the rearfoot region through the midfoot region and into the first metatarsal head region of the outsole plate. In this manner, the sole is to enhance to provide stability by substantially preventing over extension of the midfoot of a wearer.

In yet another aspect of the present invention, an article of cleated footwear includes an upper for holding a foot of a wearer and a sole having an outsole plate. A plurality ground engaging members extend downwardly from the outsole plate to provide traction and an elongated member is coupled to the outsole plate. The elongated member may be composed of a nickel-titanium alloy.

The present invention advantageously applies features and structures to the forces applicable to the different areas of an shoe, particularly the sole, in order to enhance propulsion, stability, and support in the specific regions. In addition, the shoe has increased life due to the composition of the flex control member. These advantages, in turn, provide improved performance, minimize injuries for the wearer of the shoe, and reduce overall costs of using the shoe.

These and other aspects, features and advantages of the present invention will be readily apparent and fully understood from the following detailed description of preferred embodiments, taken in connection with the appended drawings, which are included by way of example and not by way of limitation with regard to the claimed invention, in which like reference numerals identifying the elements throughout.

DETAILED DESCRIPTION OF THE PREFERRED EMBODIMENTS

FIGS. 1–6 illustrate one preferred embodiment of a cleated article of footwear, for example a soccer shoe. The cleated article of footwear is generally referred to herein as a shoe 10. Shoe 10 includes an upper 12 being attached to a sole 20 having a plurality of downwardly extending cleats or ground engaging members 40. In use, when the wearer's shoe 10 strikes a ground surface, ground engaging members 40 generally penetrates downwardly into the underlying ground surface, such as grass, soil, or artificial turf.

Figure 3:
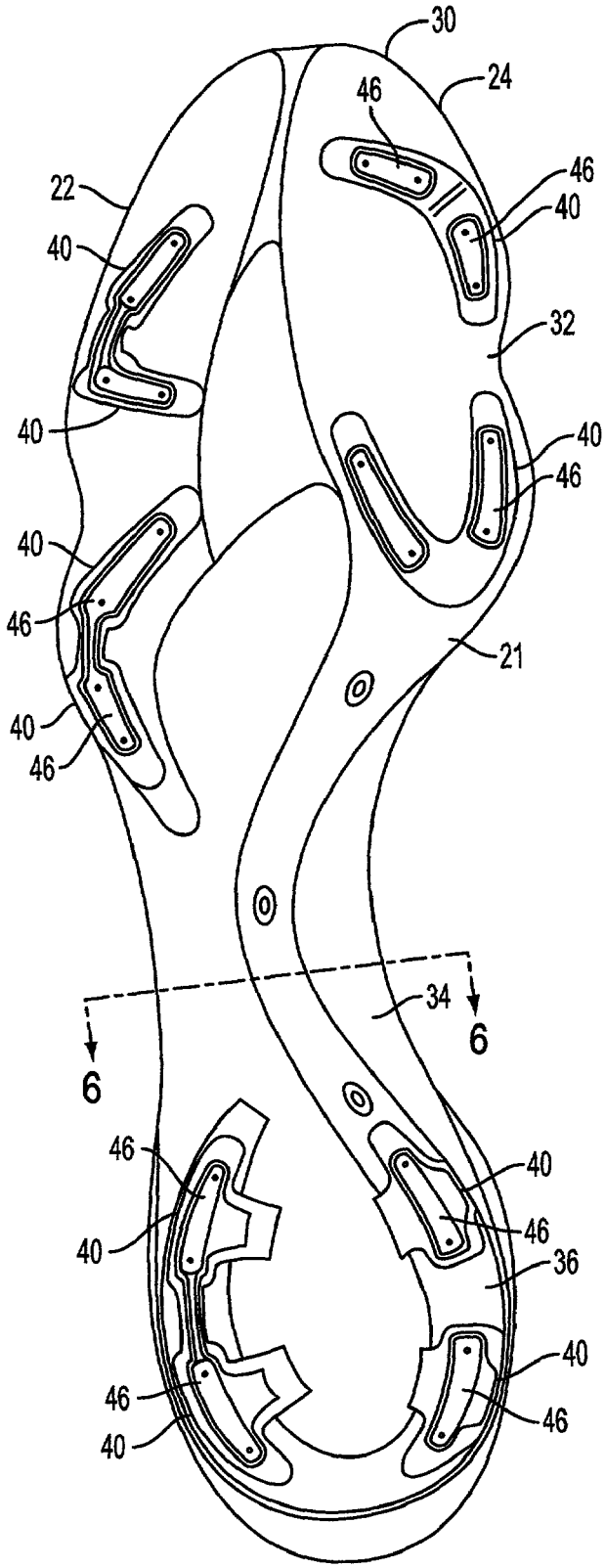
FIG. 3 is a schematic bottom plan view of the article of footwear of FIG. 1 with a flex control member.

In one arrangement, as shown in FIG. 3, sole 20 includes a flex control member 21 composed of a superelastic shape memory material or a nickel titanium alloy which provides sole 20 with increased spring-like energy return for faster and stable acceleration movement of the wearer of shoe 10. In another arrangement, flex control member 21 is anatomically positioned in the sole to enhance stability by substantially preventing over extension of the midfoot of a wearer. In an embodiment of the invention, the positioning and composition of flex control member 21 enables ground engaging members 40 to quickly release from the penetrated underlying ground surface. For ease of explanation regarding directions, when shoe 10 is worn, lateral side 22 is generally oriented on the side facing away from of the centerline of a wearer's body. The medial side 24 is generally oriented on the side facing towards the centerline of a wearer's body.

Figure 1:
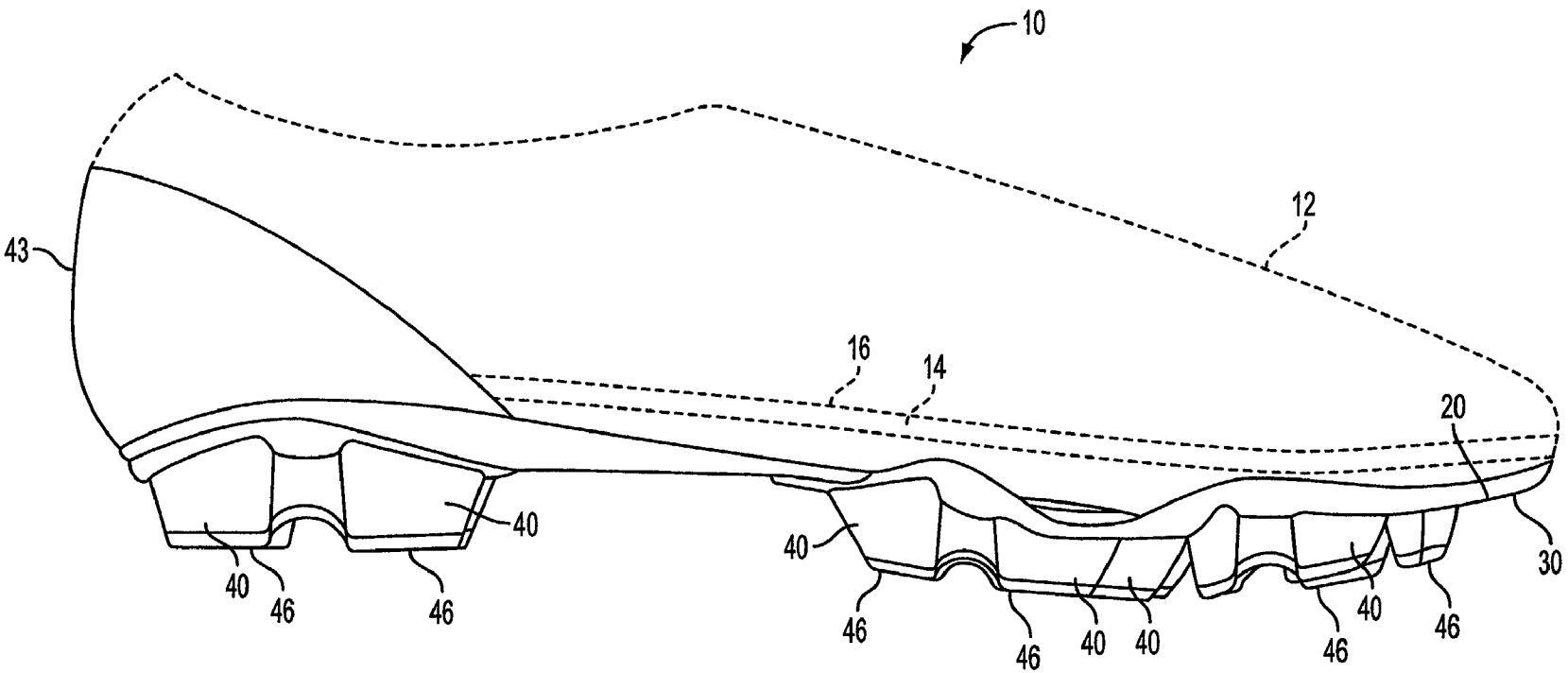
FIG. 1 is a schematic side elevational view of a lateral side of an article of footwear.
Figure 2:
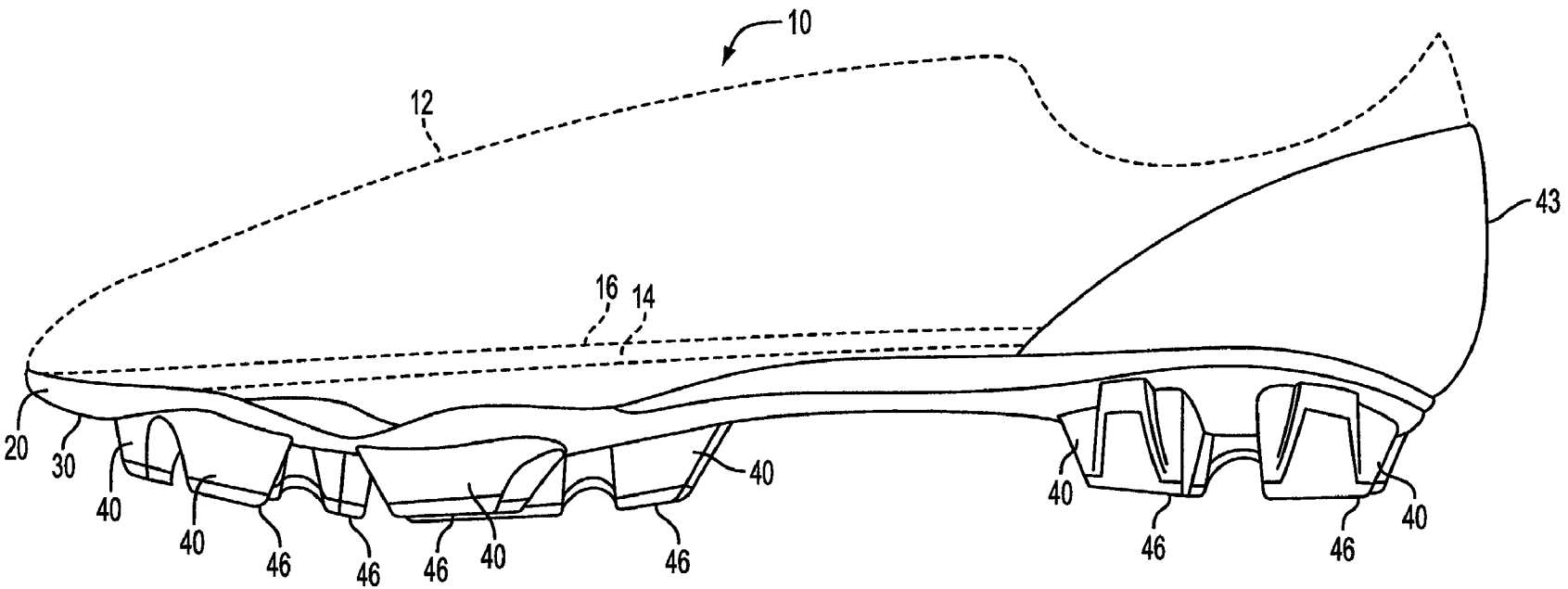
FIG. 2 is a schematic side elevational view of a medial side of the article of footwear shown of FIG. 1.
Figure 6:
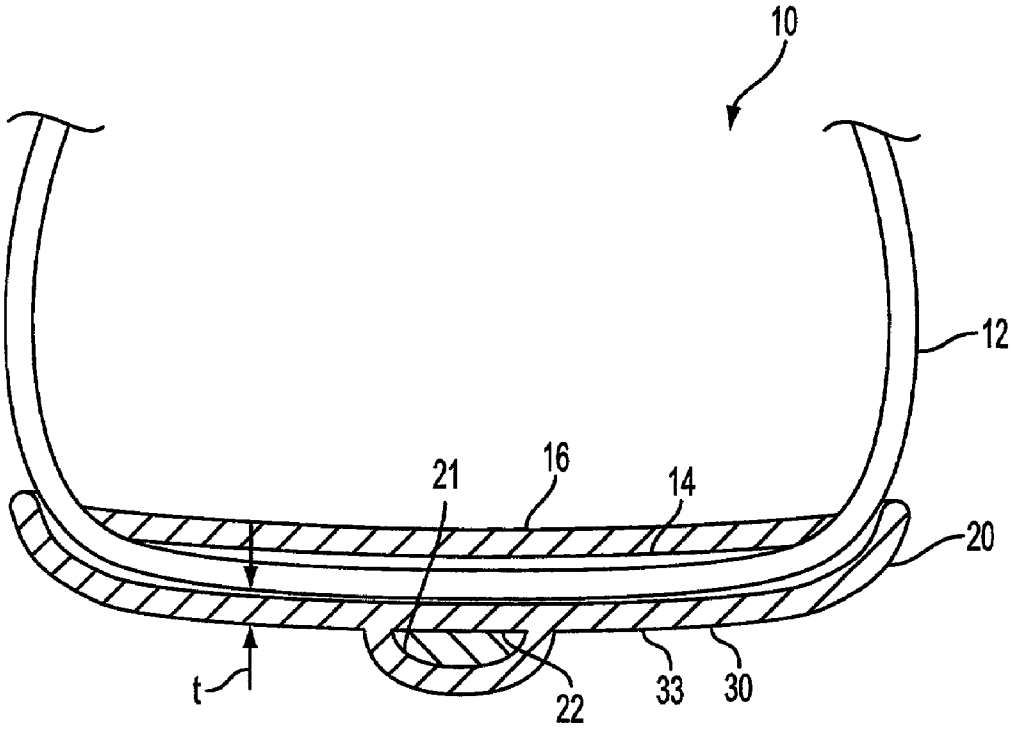
FIG. 6 is a partial schematic section view of the article of footwear taken along line 6–6 in FIG. 3.

Referring to FIGS. 1–3, sole 20 includes an outsole plate 30 that extends along the sole in a conventional manner, such as the full length or substantially the length of the sole. Outsole plate 30 is typically made of a substantially abrasion resistance material. Outsole plate 30 can be formed by injection molding a plastic resin into a desired shape. If desired, the resin may be filled approximately 10% to 25% fiber material by volume to form a plastic resin composite. The plastic resin composite may be an enhanced resin having a filled fibrous composition, such as nylon, glass, or graphite fiber. The resin may be a polyester or a similar material. In one arrangement, the fibers can be oriented in a heel-to-toe direction. In another arrangement, the fibers may be a chopped type mixed in the resin. The arrangements provide a relatively stiff outsole withstanding abrasion and wear from the movements of the foot against ground surfaces. Nevertheless, other materials and methods can form outsole plate 30. Referring to FIG. 6, outsole plate 30 may have a thickness t of less than 5 mm, preferably between 0.5–2.5 mm.

As used herein, the term "superelastic shape memory material" refers to a class of metal alloys that have a stress-induced phase change from austenite to martensite and upon stress release, the material springs back to this original phase and shape. The material structure of a superelastic shape memory material regarding austenite and martensite is well-known to one of ordinary skill in the metallurgy art. A NiTi material or NiTi alloy may be used as an alloy material for the flex control member 21. As used herein, a NiTi superelastic shape memory material refers to an alloy that is an intermetallic compound of nickel and titanium having nearly equal mixtures as measured by weight. One composition of a NiTi superelastic shape memory material generally has a greater percentage of nickel by weight than titanium, such as 51%–56% of nickel, and preferably 54–55% nickel. The specific percentages of nickel and titanium can be adjusted by one of ordinary skill in the art. It should be recognized that additional metals, such as copper, iron, chromium, and cobalt, can be added to fine tune various properties of a NiTi superelastic shape set material. Referring to FIG. 3, flex control member 21, in one embodiment, is preferably constructed from a superelastic shape set material commonly called NITINOL® depending upon the alloy composition. NITINOL® is a brand name which refers to Nickel Titanium Naval Ordinance Laboratory, a commercially available family of nickel titanium alloys. Among the suppliers, NITINOL® material can be obtained from NDC of Fremont, Calif. Nevertheless, there are numerous other suppliers of NiTi materials and NiTi superelastic shape set materials.

Some NiTi materials have unique material properties, such as mechanical memory. For example, the maximum memory strain generally ranges from 8.0%–8.5%, in which the material recovers its original shape after such a deformation. This property preferably enables flex control member 21 composed of a NiTi material to be highly deformed then spring back into its original undeformed shape thereby returning outsole plate into an original unflexed position. This arrangement can have elastic springback as much as 10 times greater than stainless steel. Another material parameter of a NiTi material includes, a density property of approximately 0.234 lbs per cubic inches. The density property provides for a lightweight construction of flex control member 21 and shoe 10.

Figure 4:
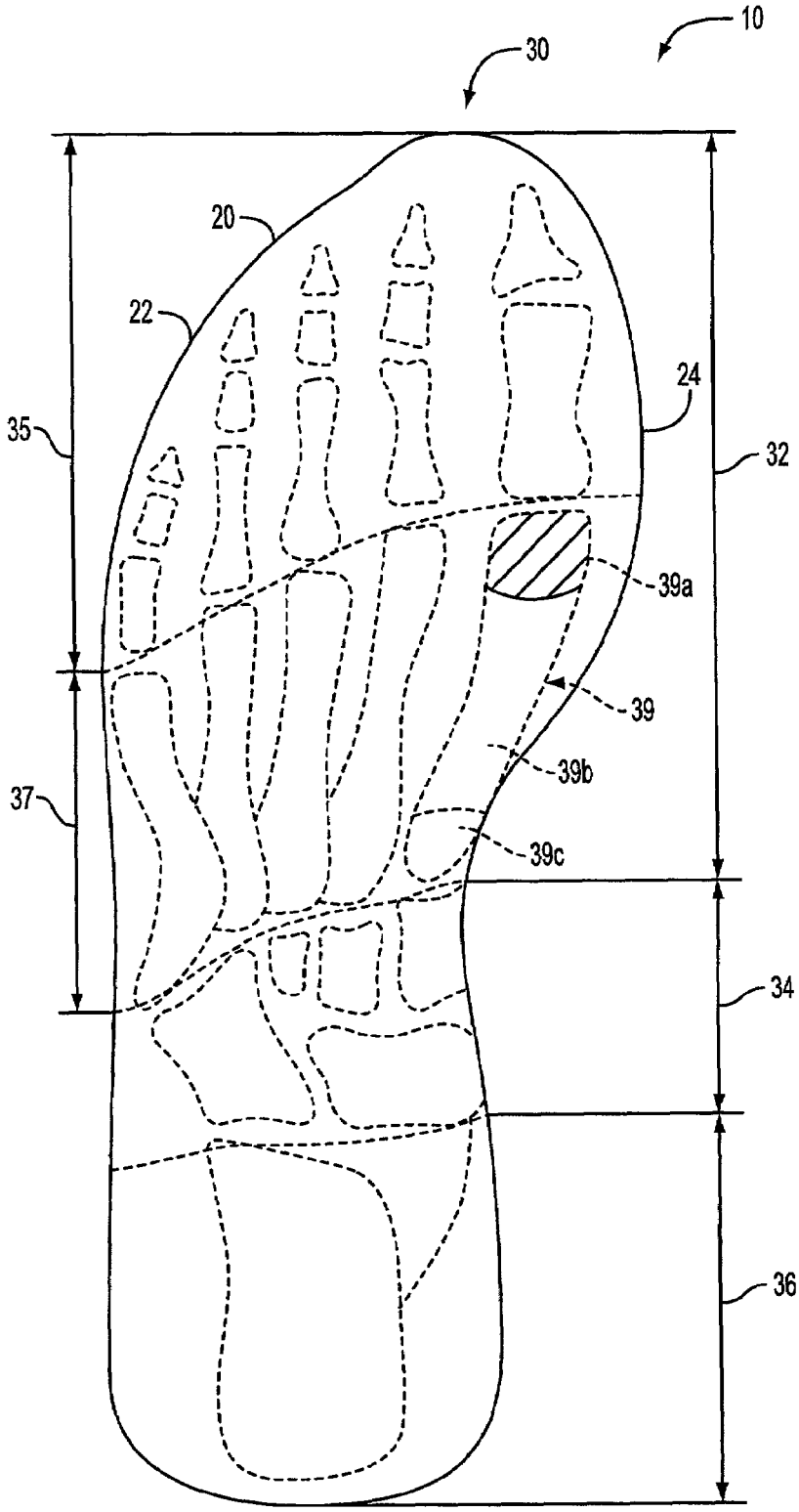
FIG. 4 is a schematic representation of the article of footwear illustrating a bottom plan view without cleats of an outsole plate with predetermined regions generally corresponding to the foot anatomy of a human body.

Referring to FIGS. 3, 4, and 6, flex control member 21 is preferably an elongated rod-like or wire-like form. In such an arrangement, the ratio of length to width may range from 2:1 to greater than 6:1, and preferably ranges from 3:1 to 5:1. Flex control member 21 may have a generally hemispherical cross-section along at least a portion of its length, as shown in FIG. 6. Nevertheless, flex control member 21 may have other desirable cross-sectional shapes, such a rectangle or a square. Member 21 may be molded with outsole plate 30, either as part of the same initial mold or as an over-molded process, to provide a strong bond. Flex control member 21 may be fastened, adhesively bonded, or otherwise fixed to outsole plate 30 by other known methods. As illustrated in FIG. 6, flex control member 21 is molded to the bottom surface 33 of outsole plate 30. In this arrangement, the bottom surface 33 forms at least portion of a planar surface and flex control member 21 is disposed is a plane generally parallel to the bottom surface 33, preferably an abutting surface 22 of member 21 to bottom surface 33 are parallel (see FIG. 6). If desired, member 21 may be molded to the inside surface of the outsole plate.

For a better understanding of the inventive article of footwear, FIG. 4 illustrates a bottom plan view of outsole plate 30 including a schematical representation with predetermined regions or portions substantially corresponding to the foot anatomy of a human body. For ease of explanation regarding the preferred embodiment, the skeletal structure of a human foot includes three major divisions—the forefoot, the midfoot, and the rearfoot. The forefoot includes forward phalanges interconnected to metatarsal bones. The phalanges and metatarsals bones are formed in five rows in which the medial side starts the first row across to the fifth row on the lateral side of the foot. The heads of the metatarsal bones have a generally bulbous structure. It should be recognized that the "great toe" structure is the first row, which includes two phalanges and a first metatarsal bone. The midfoot generally includes the arch formed by several interconnecting bones. Finally, the rearfoot includes the heel bone. One of ordinary skill in the art will recognize that the foot anatomy also includes interconnecting muscles and other tissues, which are not shown for clarity.

With continued reference to FIG. 4, outsole plate 30 is defined by a forefoot region 32, a midfoot region 34 and a rearfoot region 36. One of ordinary skill in the art should recognize that each region generally lies beneath the respective forefoot, midfoot, and rearfoot of a wearer when shoe 10 is properly sized. In forefoot region 32, outsole plate 30 is further defined by a forwardly disposed phalanx region 35, and a rearward disposed metatarsal region 37. Metatarsal region 37 includes at least—a first metatarsal region 39 including anterior head region 39*a* connected to a shaft region 39*b*, and a rearward disposed base region 39*c*. It should be appreciated that metatarsal region 37 includes a second through fifth metatarsal sub-regions corresponding to the second through fifth metatarsal bones. It should be recognized that these regions correspond to the typical anatomy of a human foot which does not deviate significantly from the norm. The outsole plate 30 includes regions not specifically described as known to one of ordinary skill in the art.

Figure 5:
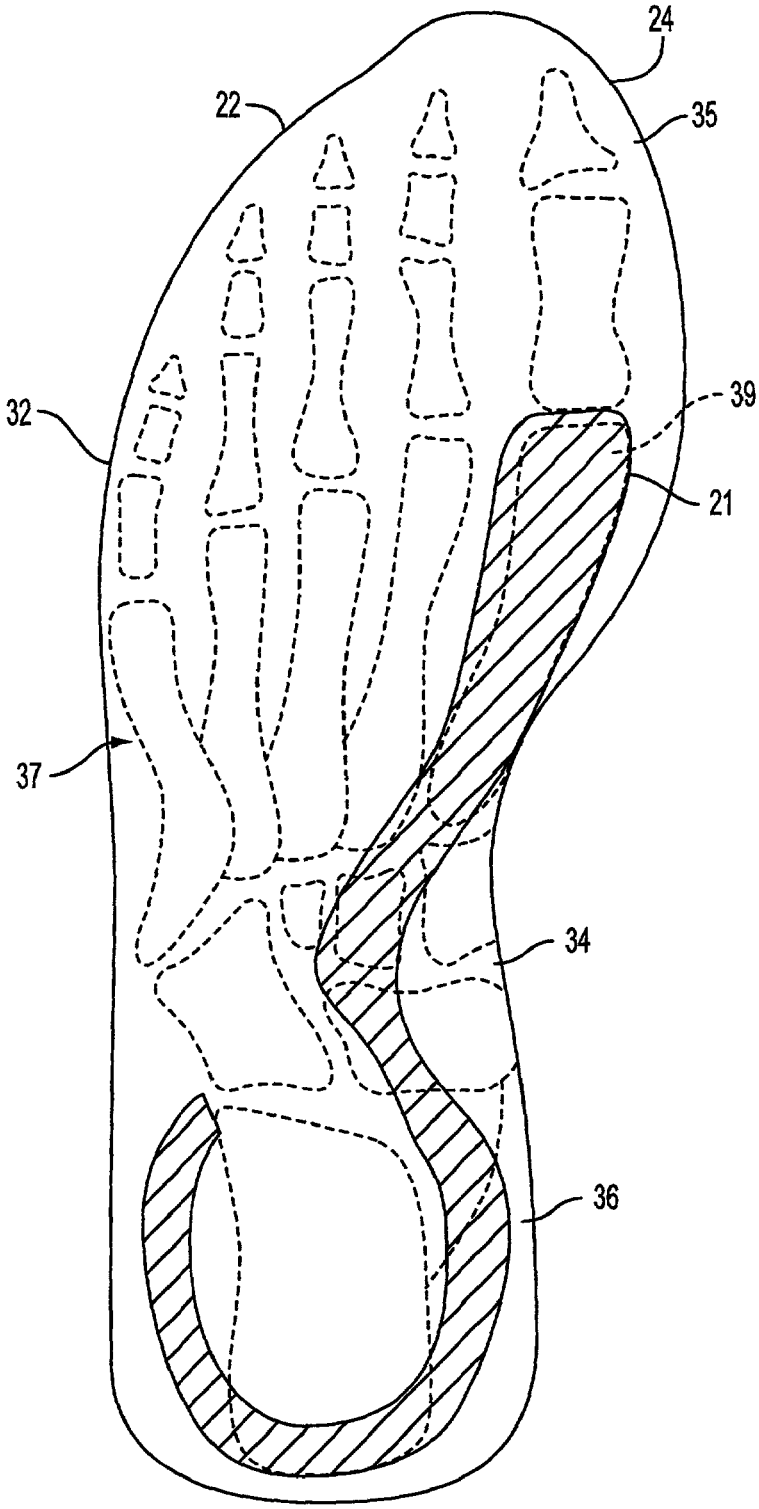
FIG. 5 is a schematic diagram of the article of footwear shown in FIG. 4 with a superimposition of a location of a flex control member.

In one embodiment, flex control member 21 employs a NiTi material, which preferably has a mechanical memory property. In this configuration, flexing or bending of the outsole plate is controlled and foot fatigue of the wearer of shoe 10 is generally reduced. Referring to FIGS. 3, 4 and 5, in one arrangement, flex control member 21 is disposed to the anatomical movement of the foot of the wearer in forefoot region 32, midfoot region 34 and rearfoot region 36 of outsole plate 30. Nevertheless, one or more the regions of the outsole plate 30, together with flex control member 21, provide enhanced performance for the wearer of shoe 10.

In a preferred construction, starting directionally from forefoot region 32, the flex control member 21 is adapted to lie beneath the first metatarsal region 39. Then, flex control member 21 extends or traverses across midfoot region 34 to the medial side and the lateral side of rearfoot region 36. Accordingly, flex control member 21 substantially supports the first metatarsal bone, the bones of the midfoot, and the medial and lateral portion of the heel bone of the wearer. In this preferred arrangement, flex control member 21 provides one or more advantages when outsole plate 30 strikes a ground surface—a springing energy return and a torsional rigidity or resistance to twisting for preventing foot rollover.

In a preferred arrangement, flex control member 21 is positioned to generally cross the midfoot region 34 in a central portion. The central portion is generally the mid-line between the lateral side 22 and medial side 24 of midfoot region 34. This arrangement controls flexibility of the outsole plate to substantially reduce over extension of the arch of the wearer. In a further aspect, flex control member 21 is positioned in rearfoot region 36 of outsole plate 30 to improve foot stability by providing energy return and resisting torsional movement to the foot of the wearer. In one arrangement of the rearfoot region 36, flex control member 21 is disposed generally along the circumference of the lateral side 22 and medial side 24 of outsole plate 30. In a further arrangement, adjacent pairs of ground engaging members 40 on lateral side 22 and medial side 24 are positioned to extend downwardly from the location of flex control member 21 in rearfoot region 36. Among the advantages, this arrangement reduces stud pressure acting on the heel bone and reduces foot rollover when the ground engaging members strike a relatively hard surface.

The ground engaging members may be any appropriate construction, such as removably replaceable, adjustable and having the shapes shown in FIG. 3 or other appropriate shapes. In a preferred construction, each ground engaging member projects downwardly from outsole plate 30 to a distal tip 46 in a generally perpendicular direction relative to a bottom surface 33 of outsole plate 30. Ground engaging members 40 are preferably molded integrally with the outsole plate 30, either as part of the same initial mold or as an overmolded process, to provide a strong bond. If desired, the ground engaging members may be fastened, or adhesively bonded, or otherwise fixed to outsole plate 30.

In an embodiment of the invention, the positioning and composition of the flex control member enables the ground engaging members to quickly release from the penetrated underlying ground surface. This feature advantageously enables the wearer to have additional forward speed on the ground surface by increased springback out of the surface penetrations as the foot of the wearer moves away upward from the surface. Accordingly, shoe 10 provides both improved traction and forward propulsion.

Referring to FIGS. 1–2, upper 12 also includes any desirable fastening system (not shown) for securing the shoe 10 to the foot of the wearer. Upper 12 is generally attached around its bottom periphery to sole 20 by a desirable conventional method such as, stitching or adhesive bonding. Upper 12 of shoe 10 can be made of any desirable material or a combination of materials such as, split-leather, full-grain leather, suede, polyester, nylon, or a breathable mesh. Shoe 10 may include an insole or a sockliner 14 disposed therein and is preferably positioned between the foot of the wearer and the sole 20. In addition, the sockliner 14 further includes a top surface defining a footbed 16, which is the portion of the shoe 10 that comes in contact with the bottom of the foot of the wearer. Sockliner 14 provides additional cushioning and shock absorption of the shoe 10. If desired, sockliner 14 may be removable and replaceable from shoe 10. If desired, shoe 10 may include a midsole for providing cushioning and support. Optionally, a heel cup 43 may be provided to firmly support the heel of the foot of the wearer.

In a further arrangement (not shown), outsole plate 30 can include one or more flex control members, in an elongated wire-like or rod-like shape, composed of any material as described above such as, a NiTi material or a NiTi superelastic shape set material. The flex control members can extend in the heel-to-toe direction of shoe 10 between the forefoot region 32 and the rearfoot region 36 of outsole plate 30. Alternatively, the flex control member 21 may be positioned to span between lateral side 22 and medial side 24 of shoe 10 in ribs to provide stability by reducing foot rollover. The flex control member 21 may be embodied in a layer of a NiTi material or a NiTi superelastic shape set material sandwiched and molded inside of the outsole plate 30. The layer of a NiTi material or a NiTi superelastic shape set material can extend the full surface area of the plate or extend individually in the forefoot region 32, midfoot region 34, and/or rearfoot region 36 of outsole plate 30.

In operation, the previously described features can be implemented on a shoe with or without cleats extending from the sole. In one aspect, the features individually and/or in any combination, improve stability and propulsion, acceleration for the wearer of the shoe. In another aspect, the flex control member's composition, positioning, or cleat configuration of shoe 10 and the synergistic effects of the features also achieves these advantages. While the various features and aspects of shoe 10 work together to achieve the advantages previously described, it is recognized that individual features and sub-combinations of these features can be used to obtain some of the aforementioned advantages without the necessity to adopt all of these features.

While the present invention has been described with reference to exemplary embodiments, it will be understood by those of ordinary skill in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiments disclosed, but that the invention will include all embodiments falling within the scope of the appended claims.

What is claimed is:

1. An article of footwear, comprising:

An upper;

an outsole plate attached to the upper having a plurality of ground engaging members extending downwardly from the outsole plate configured to provide traction; the outsole plate including a forefoot region and a rearfoot region, the ground engaging members including a first set of ground engaging members disposed in the forefoot region of the outsole plate and a second set of ground engaging members disposed in the rearfoot region of the outsole plate, the second set of ground engaging members extending downwardly from the rearfoot region; and a flex control member, the flex control member being disposed adjacent to the ground engaging members on the out sole plate, the flex control member being composed of a superelastic shape memory alloy and being an elongated wire member embedded within a portion of the outsole plate and configured so that the flex control member is surrounded by the portion of the outsole plate, wherein the second set of ground engaging members are coupled to the flex control member and collectively curve inwardly around the perimeter of the rearfoot region of the outsole plate such that the flex control member and the second set of ground engaging members surround an interior region of the rearfoot region of the outsole plate, wherein the interior region is free of the flex control member.

2. The article of footwear of claim 1, wherein the superelastic shape memory alloy includes a mixture of nickel and titanium.

3. The article of footwear of claim 2, wherein the flex control member includes a generally hemispherical cross section along at least a portion of a length of the flex control member.

4. The article of footwear of claim 2, wherein the mixture of nickel and titanium includes a nickel titanium alloy having approximately equal mixtures as measured by weight.

5. The article of footwear of claim 4, wherein the nickel titanium alloy has about a 0.23 material density.

6. The article of footwear of claim 1, wherein the outsole plate further includes a forefoot region including a first metatarsal region, and a midfoot region, in which the flex control member extends from the first metatarsal region across the midfoot region, and into the rearfoot region of the outsole plate.

7. The article of footwear of claim 6, wherein the said flex control member is coupled to at least one ground engaging member of the first set of ground engaging members, the at least one ground engaging member of the first set of the ground engaging members being configured in an U-shaped formation.

8. The article of footwear of claim 7, wherein the flex control member extends generally along a medial side of the rearfoot region of the outsole plate.

9. The article of footwear of claim 7, wherein the flex control member extends generally along a lateral side of the rearfoot region of the outsole plate.

10. The article of footwear of claim 6, wherein the superelastic shape memory alloy has a memory strain value of less than 8.50%.

11. The article of footwear of claim 6, wherein the flex control member is coupled to at least one ground engaging member of the first set of ground engaging members, the at least one ground engaging member of the first set of the ground engaging members being configured in an U-shaped formation opposite to at least one ground engaging member of the first set of ground engaging members.

12. The article of footwear of claim 1, wherein the flex control member is encompassed by a bottom surface of the outsole plate.

13. The article of footwear of claim 1, wherein the flex control member is encompassed by an inside surface of the outsole plate.

14. The article of footwear of claim 1, wherein the flex control member is disposed between a bottom surface and an inside surface of the outsole plate.

* * * * *